US005590599A

United States Patent [19]

Muller et al.

[11] Patent Number: 5,590,599

[45] Date of Patent: Jan. 7, 1997

[54] METHOD FOR REGULATING INK DISTRIBUTION IN A PRINTING MACHINE

[75] Inventors: Joachim Muller, Pullach; Rolf Braun, Offenbach, both of Germany

[73] Assignee: MAN Roland Druckmaschinen AG, Germany

[21] Appl. No.: 543,222

[22] Filed: Oct. 13, 1995

[30] Foreign Application Priority Data

Oct. 15, 1994 [DE] Germany ..... 44 36 953.0

[51] Int. Cl.[6] ..... B41F 31/04; B41F 31/14

[52] U.S. Cl. ..... 101/483; 101/365

[58] Field of Search ..... 101/349, 350, 101/351, 352, 207–210, 365, 366, 148, 484, 483

[56] References Cited

U.S. PATENT DOCUMENTS 4,660,470 4/1987 Kramp et al. .

5,010,820 4/1991 Luffler .

FOREIGN PATENT DOCUMENTS

3707695C2 1/1991 Germany .

3338143C2 12/1995 Germany .

*Primary Examiner*—J. Reed Fisher

*Attorney, Agent, or Firm*—Leydig, Voit & Mayer, Ltd.

[57] ABSTRACT

A method for regulating ink distribution in a printing machine is disclosed. In accordance with the disclosed method, a basic ink quantity and a compensating ink film thickness are determined for a printing plate to be loaded into the printing machine. All of the inking rollers of the printing machine are fed ink until the ink thickness on each roller is substantially equal to the compensating ink thickness. A steady state ink distribution within the printing machine will be attained relatively quickly, thereby minimizing print waste and time required to attain steady state.

8 Claims, 1 Drawing Sheet

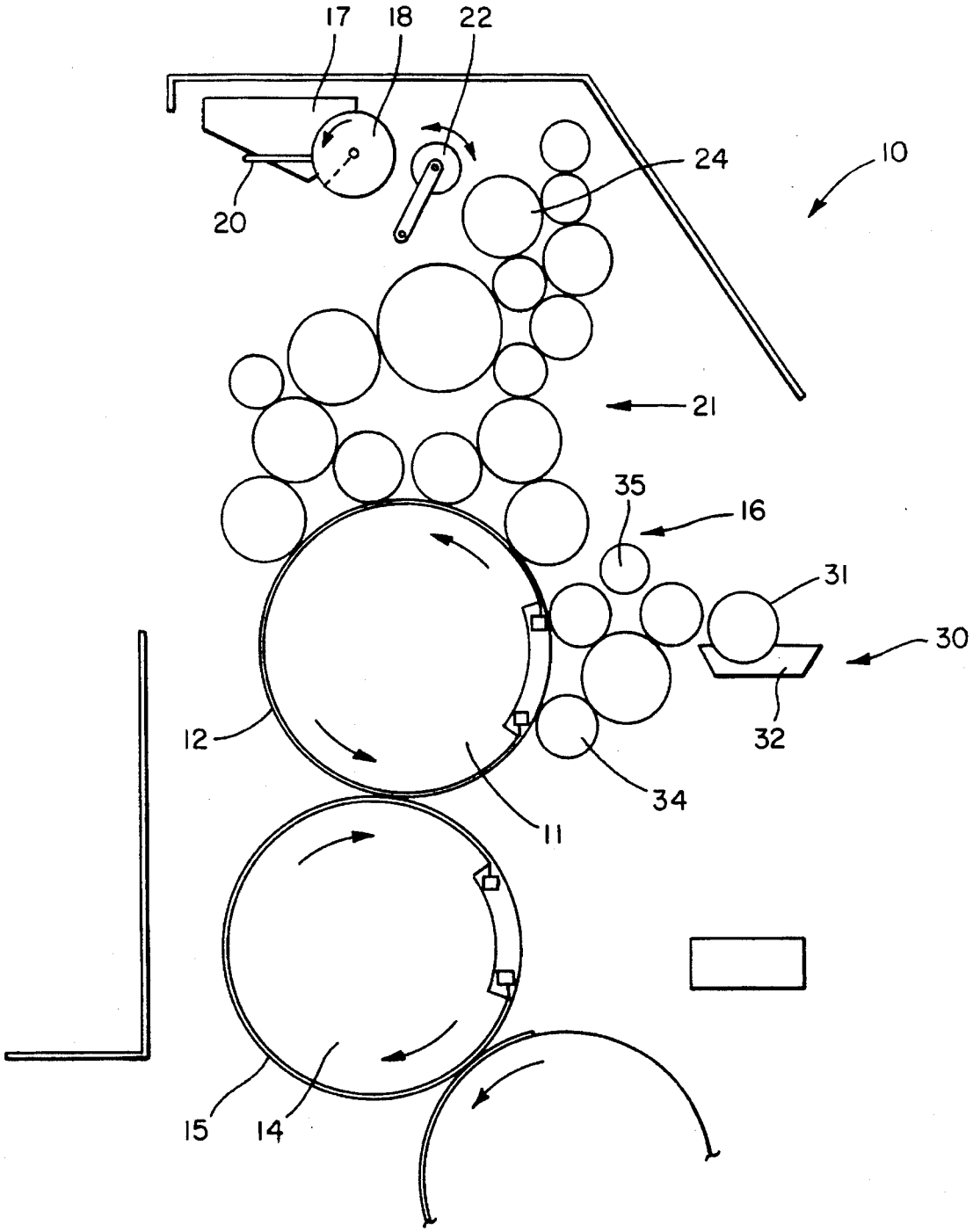
17
18
22
24
10
20
21
35
16
31
30
12
32
34
11
15
14

METHOD FOR REGULATING INK DISTRIBUTION IN A PRINTING MACHINE

TECHNICAL FIELD OF THE INVENTION

The present invention relates to printing machines, such as sheet-fed offset printing machines. More specifically, the present invention pertains to a method of regulating the ink distribution in a printing machine, particularly during initial start-up of the printing machine or when restarting the printing machine after the printing plate has been changed.

BACKGROUND OF THE INVENTION

Conventional sheet-fed offset printing machines comprise an ink fountain, an ink fountain roller in fluid communication with the ink fountain, and a plurality of inking rollers for transferring ink to the printing plate located on the plate cylinder of the printing machine. The amount of ink required to be fed to the printing plate is dependent on a number of factors, such as the design of the printing machine and the inking requirements of the printing plate then in use. Different printing plates have different inking requirements, and different portions of the same printing plate may require different amounts of ink. Accordingly, conventional printing machines include a plurality of adjustable ink metering elements disposed zonally along the width of the printing machine, that is, transversely across the ink fountain roller. The operator adjusts the ink metering elements until the proper amount of ink is fed to the various zones of the printing plate.

After the printing machine has been operated continuously for a long period of time, the amount of ink on the inking rollers reaches a steady state. In this steady state, the amount of ink on each zone of each inking roller remains relatively constant, with exactly the amount of ink being fed to the inking roller as is required and taken off by the printing plate. In this state, high-quality prints having a consistent ink density are produced by the printing machine.

Prior to reaching the steady state, however, the printed sheets produced by the printing machine are not consistently marked by the printing machine, and tend to be of poor quality. For example, during initial start-up of the printing machine, an ink gradient, or profile, is built up between the ink fountain roller and the downstream inking rollers. The printing machine must go through a large number of revolutions before the ink profile reaches a steady state condition. Accordingly, when starting up a printing machine after a cleaning, or when changing the printing plate to prepare a new print order, the initially printed sheets will be inconsistently and improperly inked.

The prior art has sought to provide a method for loading ink into the printing machine in advance of commencement of printing in an effort to mitigate the waste of time and sheets occurring before steady state is reached. For example, in DE 3,707,695 C2, a method for the defined production of an ink distribution is described. Between printing orders, the ink present in inking unit is reduced to a minimum amount by closing all of the zonally distributed ink metering elements. After the ink quantity in the inking unit has been minimized, the new distribution of ink required by the new printing plate is produced within the inking unit. In one embodiment of the disclosed method, the difference in ink quantity between two printing orders is determined by means of a computer, and is created by appropriate adjustment of the ink metering elements. The ink may be transported both from the inking unit to the ink fountain and in the reverse direction, i.e., from the ink fountain to the inking unit, as a result of the ink film thickness profile present in the printing machine. However, the method described in this reference is limited to the adjustment of the ink profile between two printing orders.

A preadjustment of an inking unit is described in DE 3,338,143 A1. In this reference, a method of filling an empty inking unit is described. The ink film thickness profile corresponding to the inking requirements of the particular printing plate loaded into the printing machine is produced on the inking rollers. The disclosed method is limited to the initial filling of the inking unit with ink, and the procedure for creating the ink profile within the empty inking unit may be complicated.

The foregoing references describe methods that are limited respectively to regulating the ink distribution in the printing machine between two printing orders and to regulating the ink distribution in a clean inking unit prior to commencement of printing. Moreover, the running-on steady state cannot be achieved precisely in either method, and the ink transport can be optimized only with difficulty. In addition, in certain cases where large differences between the intended ink flow and the actual ink flow are possible, the waste of printing sheets and printing time is actually increased, rather than decreased.

Accordingly, a need exists for a method of filling an inking unit with ink, the method suitable for use prior to commencement of printing or between printing orders. A need further exists for a method of filling an inking unit that allows for optimum preparation of the inking unit for a given print order, without significant complexity or expense.

BRIEF SUMMARY OF THE INVENTION

In accordance with the present invention, a compensating ink film thickness for a predetermined print order is adjusted and supplied in advance uniformly to each of the inking rollers. The compensating ink film thickness is that thickness of ink that is rendered by an evening-out of the ink distribution after the ink distribution has reached a steady state. This compensating ink film thickness can be determined empirically, or can be theoretically calculated from the area of the inking portion of the printing plate, i.e., the portion that is required to be inked. It has been observed that the steady state will be reached relatively quickly after commencement of printing if the compensating ink film thickness is applied to each of the inking rollers. In a particularly preferred embodiment, the printing plates are divided into categories corresponding to an amount of ink, for example, light, medium, and heavy. The compensating ink film thickness required for each category may be determined in advance. When a new film printing plate is feed to the printing machine, the category into which the new printing plate falls is determined, and a compensating ink film thickness corresponding to that category then is applied to the inking rollers prior to commencement of printing.

BRIEF DESCRIPTION OF THE FIGURE

The FIGURE is a schematic representation of a sheet-fed, offset printing machine.

DESCRIPTION OF THE PREFERRED EMBODIMENTS

As illustrated in the FIGURE, a conventional sheet-fed offset printing machine 10 comprises a plate cylinder 11 onto which is mounted a printing plate 12. The printing plate 12 and plate cylinder 11 engage a rubber blanket cylinder 14 bearing a rubber blanket 15. For providing ink to the plate cylinder 11 and printing plate 12, the printing machine 10 includes an inking unit 16. The inking unit 16 includes an ink fountain 17 fluidically communicating with an ink fountain roller 18. An ink film is thereby generated on the surface of the ink fountain roller 18. The thickness of the ink film, and thus the amount of ink transferred from the ink fountain 17, is zonally regulated by a plurality of adjustable ink metering elements 20 (one of which is shown in the FIGURE). The ink metering elements are disposed zonally along the width of the printing machine, transversely across the ink fountain roller. Each ink metering element 20 regulates a respective amount of ink fed to an individual respective printing zone across the width of printing plate 12 and plate cylinder 11.

The inking unit further includes a long series, or train, of inking rollers 21. The printing machine includes means for transferring ink from the ink fountain roller to the series of inking rollers. In a preferred embodiment, the transfer means comprises an intermittent ductor roller 22, which oscillates between the ink fountain roller and a first inking roller 24. The ink strip transferred by the intermittent ductor roller 22 is split according to known ink-splitting laws as it passes through the series of inking rollers to the printing plate.

The printing machine further includes means for selectively preventing and allowing ink to flow from the ink fountain roller to the printing plate. Preferably, the machine includes means for throwing the inking rollers onto and off of the printing plate. The printing machine further includes means for driving the inking unit rollers in the absence of continuous printing when the inking rollers are thrown off of the printing plate. Preferably, the inking rollers are driven separately from the plate cylinder 11 by a motor or an independent transmission driven from the rotation of the plate cylinder 11.

The method of the present invention includes the steps of determining a basic ink quantity for a predetermined print order for filling the inking unit, the basic ink quantity being independent of the zonal ink requirements of the printing plate; determining a compensating ink film thickness for the inking rollers from the basic ink quantity; adjusting each of the ink metering elements in accordance with the corresponding compensating ink film thickness; and, while said inking rollers are thrown off of the printing plate, feeding ink to the inking rollers until the thickness of the ink on each of the inking rollers is substantially equal to the compensating ink film thickness. Preferably, the method is printed simultaneously with other start-up operations. This method is premised on the assumption that profiling of the ink quantity in the inking unit is generally not required prior to commencement of printing, either initially or between two printing orders. It is only necessary to distribute a particular ink volume within the inking unit, that is, on the inking rollers.

Printing ink generally is distributed within the printing machine according to well known principles of ink transport, the most general of which is that ink tends to transfer from thicker ink films towards thinner ink films. Thus, for an empty, washed inking unit, such as is present at the beginning of a working day, printing ink is transported only from the ink fountain downstream to the inking rollers. When there is a change of printing plates, the ink will be transported depending upon how the ink film thickness distribution appears in the inking unit from the preceding printing order. Thus, ink may be transferred in a downstream direction, i.e., towards the inking rollers. Ink also may be transported from the downstream inking rollers back to the ink fountain rollers, and to the ink fountain itself, if the ink film thicknesses on the inking unit rollers are greater than on the ink fountain roller.

It has been observed that, if a printing process is interrupted while in the steady state, and if the inking unit continues to be operated, the differences in the ink film thicknesses are evened out on the rotating inking rollers. That is, the ink thickness on the inking rollers will equilibrate, or even-out, to a substantially uniform thickness. If the printing process is then resumed, the former steady state will then be regained relatively quickly, after only a few revolutions of the printing machine. The compensating ink film thickness may be defined as the film thickness produced on the inking rollers after the evening-out operation has proceeded. It is this compensating ink film thickness that is applied to the inking rollers prior to commencement of printing, or between printing orders, to thereby minimize the time and number of revolutions required to attain steady state.

In carrying out the present inventive method, a basic ink quantity for filling the inking unit and a compensating ink film thickness are determined. The basic ink quantity and film thickness may be calculated mathematically for a model of the inking unit in accordance with the ink requirements of the printing plate. Preferably, however, the basic ink quantity and compensating ink film thickness are simultaneously determined empirically, by the steps of throwing the inking rollers off of the printing plate after ink transport in the inking unit has reached a steady state condition, allowing the ink film thickness on each inking roller to equilibrate, and measuring the equilibrated ink thickness to thereby determine the compensating ink film thickness. If the compensating ink film thickness is determined empirically in this manner, the basic ink quantity need not be separately numerically determined.

In a particularly preferred embodiment of the invention, various categories are determined for a plurality of printing plates having different ink requirements. Each printing plate includes a printing portion, or inking portion, and a non-printing portion, or non-inking portion. Categories for the printing plates are determined by the relative proportion of inking to non-inking portion of each printing plate, or by the area of the printing portion. For example, three categories, "light," "medium," and "heavy," may be defined for the printing plates. The "light" category includes printing plates having 0% to about 20% printing portion. The "medium" category includes printing plates that have from about 21% to about 50% printing portion. The "heavy" category includes printing plates that have greater than 50% inking portion. To each category is permanently allocated a particular compensating ink film thickness which is determined according to the design of the specific printing machine. This data may be stored in a parameter table.

When a new printing plate is fed to the printing machine, the printing plates should be designated as falling within one of the "light," "medium," or "heavy," categories. This decision may be made subjectively by the operator of the printing machine, or, alternatively, the printing plate may be digitally scanned to determine the area of its printing portion and thereby to automatically designate the printing plate as "light", "medium", or "heavy". The compensating ink thickness corresponding to each category may be determined empirically, by providing actual printing plates within each category. Alternatively, the compensating ink thickness for each of the categories may be determined theoretically, in accordance with the measurement of the printing portion area of a printing plate known to fall within the category.

After determining the compensating ink film thickness, this compensating ink film thickness is applied to all of the inking rollers. Because a compensating ink film thickness may be quantitatively determined, as a thickness in micrometers, the ink metering elements may be precisely adjusted to load the inking unit with the corresponding compensating ink film thickness. The printing machine then is started up without paper, the ink supply is switched on, and an evening-out or equilibrating operation of ink film thus proceeds. In theory, an infinite number of revolutions is required to even-out the ink distribution; in practice, however, approximately 300 revolutions will be sufficient. It is irrelevant whether the inking rollers previously were clean or whether they still bore printing ink from the preceding printing order. Printing ink may be transported back to the ink fountain, if the basic ink quantity of the new print order is less than that of for the preceding print order.

To optimize the evening-out process, the printing machine preferably is operated at its maximum speed while the ink is feed to the inking rollers during the evening-out process. Further, the intermittent ductor roller, which typically is adjustable over a range of contact widths for contacting the ink fountain roller, is operated at its maximum contact width. Thus, ink flow between the ink fountain roller and the inking rollers is maximized, and the time required for evening-out process is minimized. For example, at a machine speed of 15,000 revolutions per hour, the entire running-in operation of 300 revolutions would last approximately 72 seconds.

After the compensating ink film thickness has been applied to all of the inking rollers, the ink metering elements preferably are then adjusted in accordance with the zonal inking requirements of the printing plate. Thus, in carrying out the method of the present invention, the ink metering elements are first adjusted equally to provide the desired compensating ink film thickness. Typically, the ink metering elements are uniformly adjusted to a width of approximately 35 μm to approximately 45 μm. The ductor strip width of the intermittent ductor roller then is adjusted to the maximum value possible, and the printing machine then is accelerated to its running-in speed, preferably the maximum printing speed of the machine. While the machine is accelerating to its maximum speed, the ink flow is allowed to commence, with the ink metering elements all adjusted to the same value. After a preselected number of machine revolutions, such as about 300 revolutions, the printing machine and ink fountain roller are stopped, and the ink profile is adjusted in accordance with the printing order. The steady state film thickness distribution will then quickly be attained and will require a minimum preliminary running time. Thus, a minimum of print waste is required before, consistent, high-quality printing may be commenced.

The printing machine preferably includes a damping unit 30, which provides damping fluid to the printing plate. The damping unit 30 includes a damping fluid roller 31 fluidically communicating with a source 32 of damping fluid. A damping fluid film is thereby generated on the surface of the damping fluid roller 31. The damping unit further incudes means for transferring the damping fluid to at least one damping roller 34, the damping unit including means for throwing the damping roller onto and off of the printing plate. The printing machine preferably further includes a bridge roller 35 fluidically connecting the inking unit and the damping unit, wherein the bridge roller is switchable between a position in which the bridge roller fluidically connects the inking unit and the damping unit and a position wherein the bridge roller does not fluidically connect the inking unit and the damping unit. This bridge roller is provided to control the ink/water equilibrium during the printing process, inasmuch as the damping roller may also have to be provided with the printing ink. It is preferred not to apply printing ink to the damping fluid roller too early, in which case an emulsion may form and may impede the printing process. Thus, the bridge roller 35 preferably is operable independently of the other systems of the printing machine when applying the printing ink.

In accordance with the invention, the present inventive method further includes the steps of: (a) after the step of feeding ink to the inking rollers, throwing the inking rollers onto the printing plate to thereby transfer ink thereto; (b) subsequently throwing the inking rollers off of the printing plate; and (c) subsequently throwing the damping roller or rollers onto the printing plate to thereby apply damping fluid thereto. After the inking rollers have initially been thrown onto the printing plate, the printing plate will then be completely coated with printing ink. When the damping rollers are thrown onto the printing plate, however, printing ink will be removed from the non-printing portions of the printing plate, because of the ink-receptive surface characteristic of the damping roller. When the damping rollers, but not the inking rollers, are thrown onto the printing plate, the printing machine is said to be "running free." In such condition, the damping rollers are provided with printing ink.

In a particularly preferred embodiment, a pre-adjustment menu is provided for the running-in operation. The pre-adjustment menu is provided with data for regions of coverage values of the printing plates, for the setting of ink metering elements. Correction factors for each printing unit also may be provided, as may a running-in speed and number of revolutions for the running-in operation. These values may be adjustable by the operator. The operator thus can specify whether a printing unit is or is not to be provided with printing ink and whether the damping roller is provided with an ink film. The ink supply for each inking unit is controlled by the operator using the correction factors and other settings in the pre-adjustment menu.

While particular embodiments of the invention have been shown, it will of course be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention. All references cited herein are hereby incorporated by reference in their entireties.

What is claimed is:

1. A method for regulating ink distribution to a printing plate in a printing machine for a particular print order, the printing machine having an inking unit comprising an ink fountain, an ink fountain roller fluidically communicating with said ink fountain, whereby an ink film is generated on the ink fountain roller, a plurality of inking rollers for conveying ink from said ink fountain to said printing plate said ink fountain and said ink fountain roller having a plurality of adjustable ink metering elements disposed zonally along the width of said ink fountain for regulating the respective amounts of ink fed to individual respective printing zones across the width of the printing plate, said inking unit including means for transferring ink from said ink fountain roller to said plurality of inking rollers, at least one of said inking rollers being engageable with said printing plate, the machine including means for throwing said one inking roller onto and off of said printing plate and including means for driving said ink fountain roller and said inking rollers in the absence of continuous printing when said one inking roller is thrown off of the printing plate, the method comprising the steps of:

determining a compensating ink film thickness for said inking rollers to satisfy the inking requirements for said particular print order, said compensating ink film thickness being independent of the zonal ink requirements of the printing plate for said particular print order and corresponding to an ink film thickness necessary to produce a basic ink quantity equal to the total amount of ink continuously present in the printing unit during printing to satisfy the inking requirements for said particular print order after ink transport in said inking unit has reached a steady state printing condition;

adjusting each of said ink metering elements in accordance with said corresponding compensating ink film thickness; and feeding ink to said inking rollers until the thickness of said ink on each of said inking rollers is substantially equal to said compensating ink film thickness while said one inking roller is thrown off of said printing plate;

wherein said compensating ink film thickness is determined by the steps of:

throwing said one inking roller off of said printing plate after ink transport in said inking unit has reached a steady state printing condition;

allowing the ink film thickness on each inking roller to equilibrate; and measuring said equilibrated ink film thickness to thereby determine said compensating ink film thickness.

2. A method according to claim 1, further comprising the step of:

zonally adjusting the ink metering elements in accordance with the inking requirements of the printing plate after the thickness of said ink on each of said inking rollers is substantially equal to said compensating ink film thickness.

3. A method according to claim 1, further comprising the steps of:

defining a plurality of categories for a plurality of printing plates, each of said categories corresponding to a different ink requirement for said printing plates;

determining a compensating ink film thickness for each of said categories;

providing a printing plate;

determining which of said categories defines said printing plate; and adjusting said ink metering elements in accordance with said category wherein, for each of said categories of printing plates, said compensating ink film thickness is determined by the steps of:

throwing said one inking roller off of said printing plate after ink transport in said inking unit has reached a steady state printing condition;

allowing the ink film thickness on each inking roller to equilibrate; and measuring said equilibrated ink film thickness to thereby determine said compensating ink film thickness.

4. A method according to claim 1, wherein said printing machine is operable over a range of printing speeds, wherein said printing machine is operated at its maximum speed during said step of feeding ink to said inking rollers until the thickness of said ink film on each of said inking rollers is substantially equal to said compensating ink film thickness.

5. A method according to claim 1, wherein said means for transferring ink from said ink fountain roller to said plurality of inking rollers includes an intermittent ductor roller for contacting said ink fountain roller over a range of contact widths, wherein said intermittent ductor roller is operated at its maximum contact width during said step of feeding ink to said inking rollers until the thickness of said ink film on each of said inking rollers is substantially equal to said compensating ink film thickness.

6. A method according to claim 1, wherein said ink is fed to said inking rollers over at least about 300 revolutions of said printing machine.

7. A method according to claim 1, wherein said printing machine further comprises a damping unit, said damping unit including a damping fluid roller fluidically communicating with a source of damping fluid, whereby a damping fluid film is generated on the surface of the damping fluid roller, means for transferring said damping fluid to at least one damping roller, said damping unit including means for throwing said damping roller onto and off of said printing plate, said printing machine further including a bridge roller fluidically connecting said inking unit and said damping unit, said bridge roller being switchable between a position in which said bridge roller fluidically connects said inking unit and said damping unit and a position in which said bridge roller does not fluidically connect said inking unit and said damping unit, the method further comprising the steps of:

fluidically disconnecting said inking unit and said damping unit prior to said step of feeding ink to said inking rollers;

throwing said one inking roller onto said printing plate to thereby transfer ink thereto after said step of feeding ink to said inking rollers;

subsequently throwing said one inking roller off of said printing plate; and subsequently throwing said damping roller onto said printing plate to thereby apply damping fluid thereto.

8. A method according to claim 7, further comprising the step of:

zonally adjusting the ink metering elements in accordance with the inking requirements of the printing plate after the thickness of said ink on each of said inking rollers is substantially equal to said compensating ink film thickness.

* * * * *